US007955683B1

(12) United States Patent
Ferrell et al.

(10) Patent No.: US 7,955,683 B1
(45) Date of Patent: Jun. 7, 2011

(54) MAGNETIC ANCHORING TOWEL SYSTEM

(76) Inventors: Gretchen A. Ferrell, Valrico, FL (US); William M. Ferrell, Valrico, FL (US)

( * ) Notice: Subject to any disclaimer, the term of this patent is extended or adjusted under 35 U.S.C. 154(b) by 0 days.

(21) Appl. No.: 12/807,381

(22) Filed: Sep. 3, 2010

Related U.S. Application Data

(60) Provisional application No. 61/240,870, filed on Sep. 9, 2009.

(51) Int. Cl.
*B32B 3/06* (2006.01)

(52) U.S. Cl. ..... 428/99; 15/209.1

(58) Field of Classification Search ..... 428/99; 15/209.1; 24/303
See application file for complete search history.

(56) References Cited

U.S. PATENT DOCUMENTS 7,299,573 B1 * 11/2007 Kuncken ..... 38/140
2007/0039141 A1 * 2/2007 Rairden ..... 24/303
* cited by examiner

*Primary Examiner* — Alexander Thomas

(57) ABSTRACT

A towel has parallel first and second side edges and parallel first and second end edges. The towel has a top surface and an under surface. A first patch with stitching couples the first patch to the under surface of the tower adjacent to the first side edge and to the first end edge. In this manner a first pocket is formed. A magnet is positioned within the first pocket. A second patch with stitching couples the second patch to the under surface of the tower adjacent to the second side edge and to the first end edge. In this manner a second pocket is formed. A disc with ferro magnetic properties is positioned within the second pocket.

5 Claims, 6 Drawing Sheets

MAGNETIC ANCHORING TOWEL SYSTEM

RELATED APPLICATION

The present non-provisional patent application is based upon Provisional Patent Application Ser. No. 61/240,870 filed Sep. 9, 2009 the subject matter of which is incorporated herein by reference.

BACKGROUND OF THE INVENTION

Field of the Invention

The present invention relates to a magnetic anchoring towel system and more particularly pertains to providing a perspiration wiping surface and for reliable positioning and repositioning such surface, the providing and positioning and repositioning being done in a safe, sanitary, convenient and economical manner.

SUMMARY OF THE INVENTION

In view of the disadvantages inherent in the known types of towel systems of known designs and configurations now present in the prior art, the present invention provides an improved magnetic anchoring towel system. As such, the general purpose of the present invention, which will be described subsequently in greater detail, is to provide a new and improved magnetic anchoring towel system and method which has all the advantages of the prior art and none of the disadvantages.

To attain this, the present invention essentially comprises a magnetic anchoring towel system. First provided is a towel. The towel has long parallel first and second side edges. The side edges are separated by a minimum width of 15 inches plus or minus 10 percent and a maximum width of 16 inches plus or minus 10 percent. The towel has short parallel first and second end edges. The end edges are separated by a minimum width of 18 inches plus or minus 10 percent and a maximum width of 26 inches plus or minus 10 percent. The towel is fabricated of a cotton fiber content. The towel has a top surface. The top surface has a velour texture. In this manner a softer feel is provided. The towel has an under surface. The under surface has a looped face. In this manner more absorbency is provided. A dobby hem is formed along all side and end edges. In this manner unraveling is precluded.

Further provided is a first patch. The first patch is provided in a square configuration. Each side of the patch is between 1.50 and 1.75 inches. First peripheral stitching is provided. In this manner the first patch is coupled to the under surface of the towel adjacent to the first side edge and the first end edge. Further in this manner a first pocket is formed. A rare earth magnet is provided. The rare earth magnet has a cylindrical configuration. The magnet is positioned within the first pocket. The magnet has a diameter of between 0.75 and 1.25 inches. The magnet has a height of 0.125 inches plus or minus 10 percent. The magnet is adapted to be removably attached to a magnetically responsive object. The magnetically response object includes a handle of a weight machine. Note FIG. 5.

Provided last is a second patch. The second patch is provided in a square configuration. Each side of the patch is between 1.5 and 1.75 inches. Second peripheral stitching is provided. In this manner the second patch is coupled to the under surface of the tower adjacent to the second side edge and the first end edge. Further in this manner a second pocket is formed. A disc of an iron alloy is provided. The disc has ferro magnetic properties. The disc has a cylindrical configuration. The disc is positioned within the second pocket. The disc is adapted to be removably attached to the magnet. In this manner a first edge of the towel is formed into a loop. The loop is positionable around an object. The object includes a handle of a weight machine. Note FIG. 6. The object also includes a portion of golf equipment. Note FIG. 7.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved magnetic anchoring towel system which has all of the advantages of the prior art towel systems of known designs and configurations and none of the disadvantages.

It is another object of the present invention to provide a new and improved magnetic anchoring towel system which may be easily and efficiently manufactured and marketed.

It is further object of the present invention to provide a new and improved magnetic anchoring towel system which is of durable and reliable constructions.

An even further object of the present invention is to provide a new and improved magnetic anchoring towel system which is susceptible of a low cost of manufacture with regard to both materials and labor, and which accordingly is then susceptible of low prices of sale to the consuming public, thereby making such magnetic anchoring towel system economically available to the buying public.

Even still another object of the present invention is to provide a magnetic anchoring towel system for providing a perspiration wiping surface and for reliable positioning and repositioning such surface, the providing and positioning and repositioning being done in a safe, sanitary, convenient and economical manner.

Lastly, it is an object of the present invention to provide a new and improved magnetic anchoring towel system. A towel has parallel first and second side edges and parallel first and second end edges. The towel has a top surface and an under surface. A first patch with stitching couples the first patch to the under surface of the tower adjacent to the first side edge and to the first end edge. In this manner a first pocket is formed. A magnet is positioned within the first pocket. A second patch with stitching couples the second patch to the under surface of the tower adjacent to the second side edge and to the first end edge. In this manner a second pocket is formed. A disc with ferro magnetic properties is positioned within the second pocket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
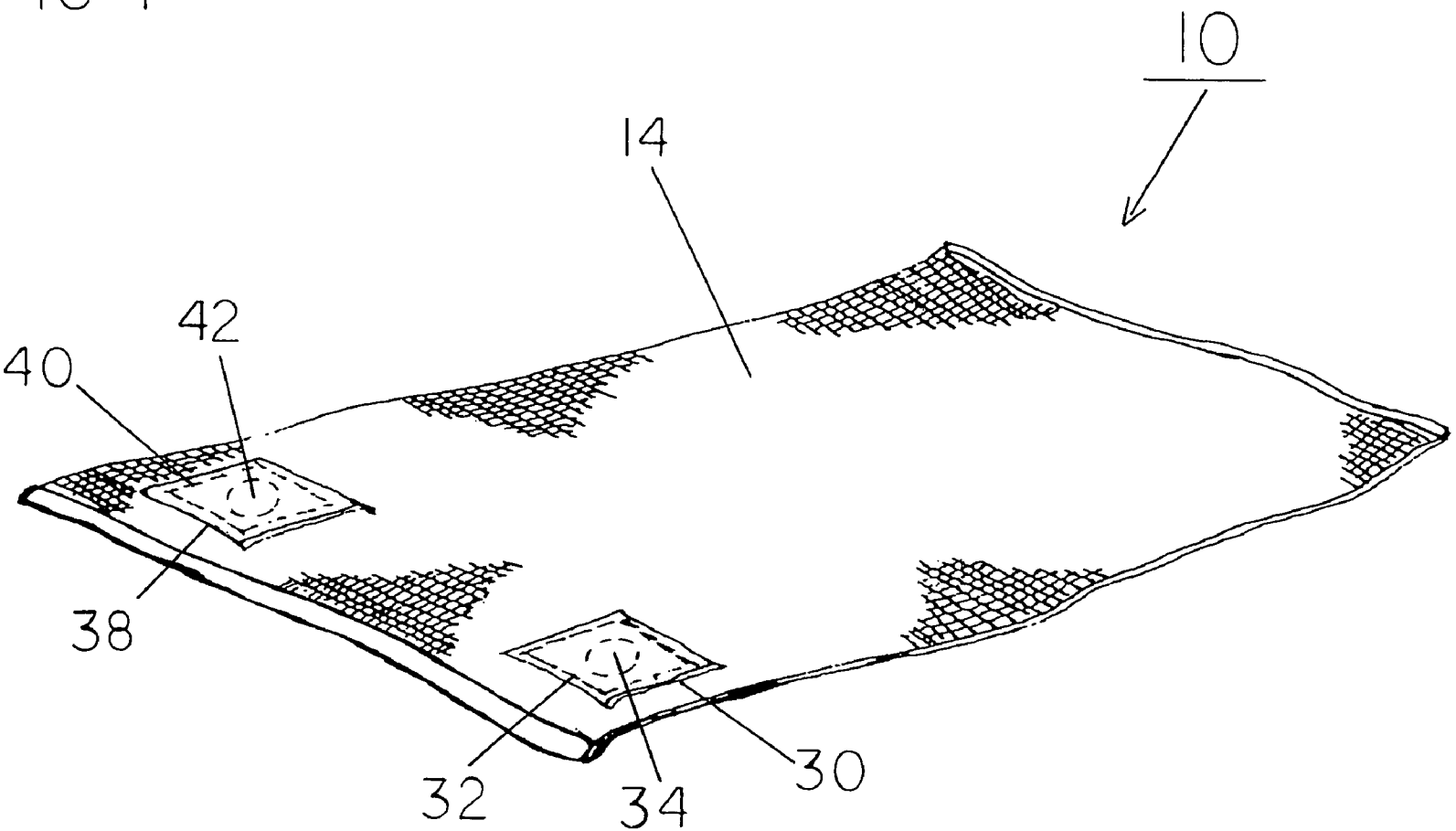
FIG. 1 is a perspective illustration of a magnetic anchoring towel constructed in accordance with the principals of the present invention.
Figure 2:
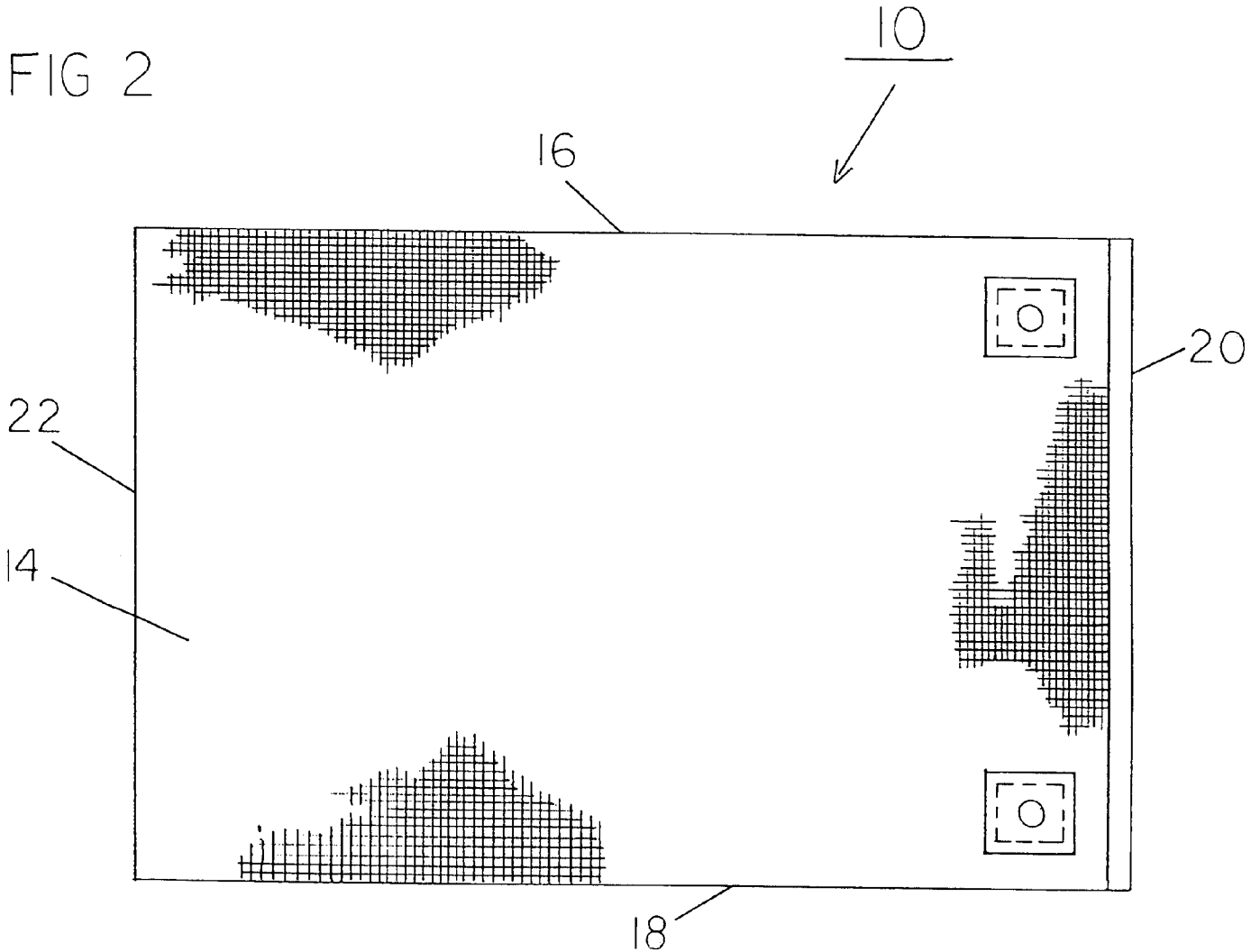
FIG. 2 is a plan view of the magnetic anchoring towel system shown in FIG. 1.
Figure 3:
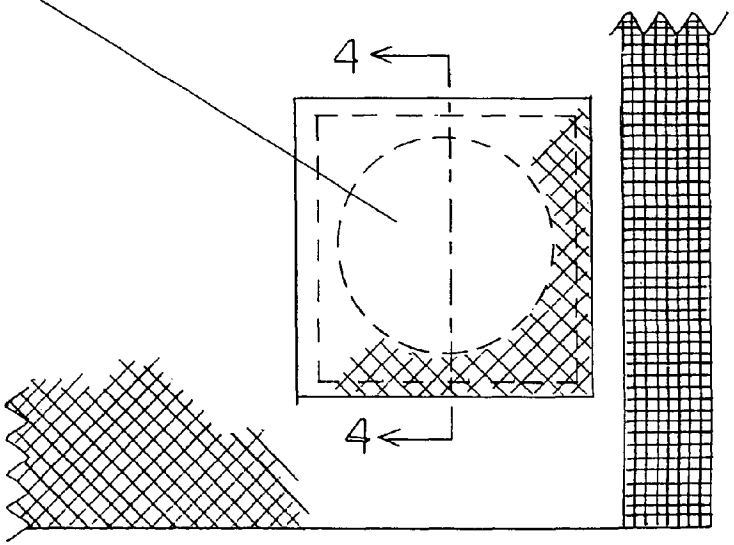
FIG. 3 is an enlarged illustration partly in cross-section taken at one corner of the system of FIGS. 1 and 2.
Figure 4:
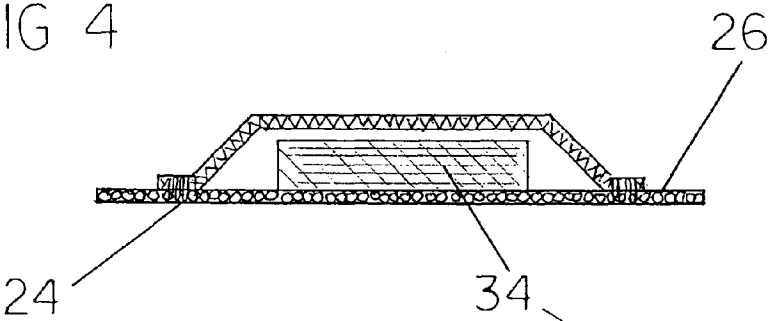
FIG. 4 is a cross-sectional view taken along line 4-4 of FIG. 3.

With reference now to the drawings, and in particular to FIG. 1 thereof, the preferred embodiment of the new and improved magnetic anchoring towel system embodying the principles and concepts of the present invention and generally designated by the reference numeral 10 will be described.

The present invention, the magnetic anchoring towel system 10 is comprised of a plurality of components. Such components in their broadest context include a towel, a first patch and a second patch. Such components are individually configured and correlated with respect to each other so as to attain the desired objective.

First provided is a towel 14. The towel has long parallel first and second side edges 16, 18. The side edges are separated by a minimum width of 15 inches plus or minus 10 percent and a maximum width of 16 inches plus or minus 10 percent. The towel has short parallel first and second end edges 20, 22. The end edges are separated by a minimum width of 18 inches plus or minus 10 percent and a maximum width of 26 inches plus or minus 10 percent. The towel is fabricated of a cotton fiber content. The towel has a top surface 24. The top surface has a velour texture. In this manner a softer feel is provided. The towel has an under surface 26. The under surface has a looped face.

In this manner more absorbency is provided. A dobby hem is formed along all side and end edges. In this manner unraveling is precluded.

Figure 5:
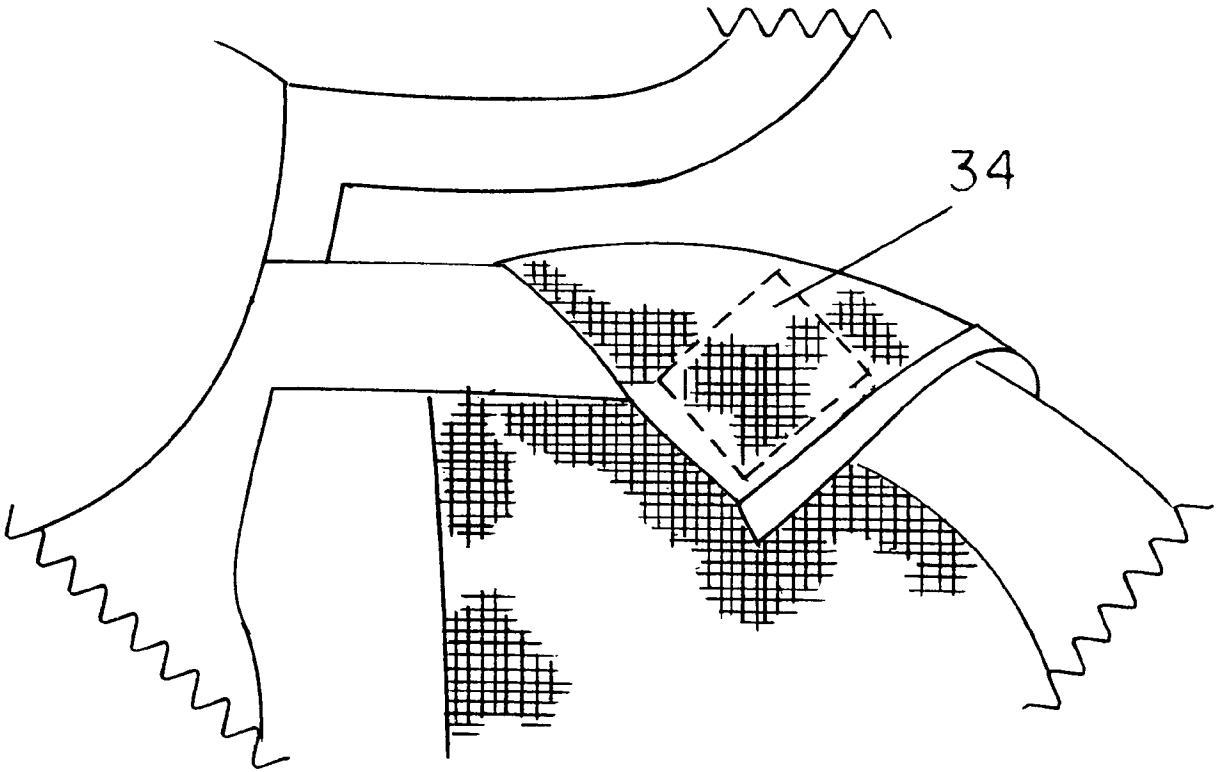
FIG. 5 is a perspective illustration of the system of the prior Figures magnetically coupled to a portion of an exercise machine.

Further provided is a first patch 30. The first patch is provided in a square configuration. Each side of the patch is between 1.50 and 1.75 inches. First peripheral stitching 32 is provided. In this manner the first patch is coupled to the under surface of the tower adjacent to the first side edge and the first end edge. Further in this manner a first pocket is formed. A rare earth magnet 34 is provided. The rare earth magnet has a cylindrical configuration. The rare earth magnet does not need to be removed for laundering because this type of magnet can be machine washed and machine dried. The magnet is positioned within the first pocket. The magnet has a diameter of between 0.75 and 1.25 inches. The magnet has a height of 0.125 inches plus or minus 10 percent. The magnet is adapted to be removably attached to a magnetically responsive object. The magnetically responsive object includes a handle of a weight machine. Note FIG. 5.

Figure 6:
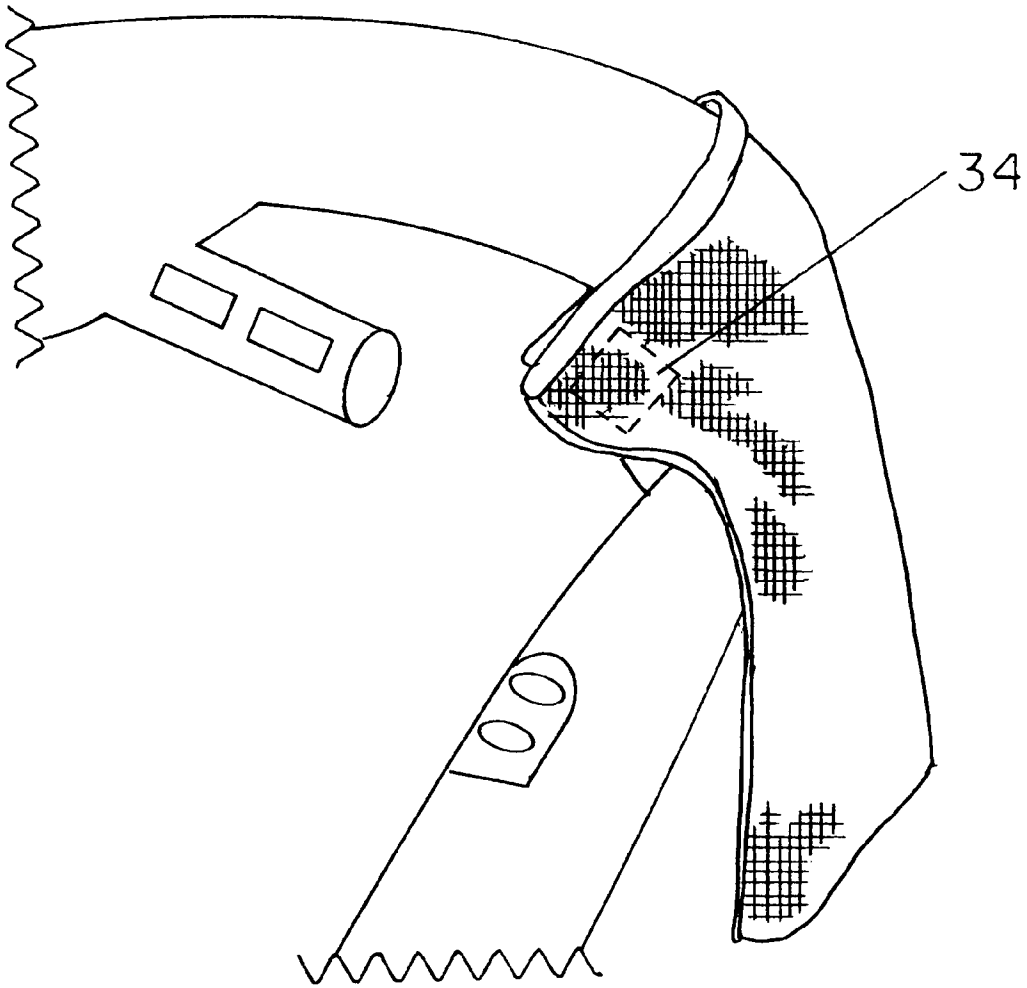
FIG. 6 is a perspective illustration of the system of the prior Figures looped around a portion of an exercise machine and then magnetically coupled adjacent to the towel ends.
Figure 7:
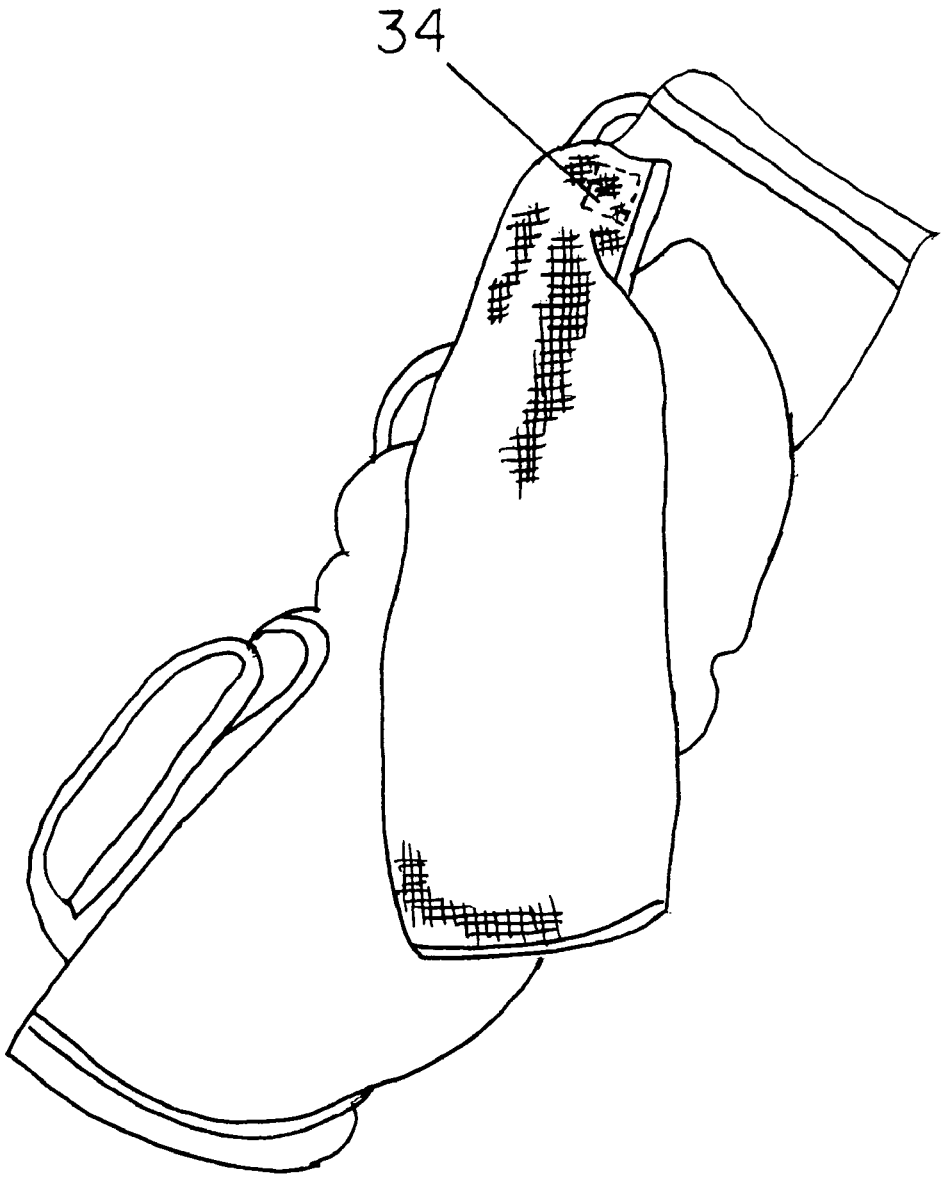
FIG. 7 is a perspective illustration of the system of the prior Figures looped around a golf bag handle and then magnetically coupled adjacent to the towel ends.

Provided last is a second patch 38. The second patch is provided in a square configuration. Each side of the patch is between 1.5 and 1.75 inches. Second peripheral stitching 40 is provided. In this manner the second patch is coupled to the under surface of the tower adjacent to the second side edge and the first end edge. Further in this manner a second pocket is formed. A disc 42 of an iron alloy is provided. The disc has ferro magnetic properties. The disc has a cylindrical configuration. The disc is positioned within the second pocket. The disc is adapted to be removably attached to the magnet. In this manner a first edge of the towel is formed into a loop. The loop is positionable around an object. The object includes a handle of a weight machine. Note FIG. 6. The object also includes a portion of golf equipment. Note FIG. 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A magnetic anchoring towel system consisting of:

a towel having parallel first and second side edges and parallel first and second end edges, the towel being fabricated with a top surface and an under surface;

a first patch with stitching coupling the first patch to the under surface of the tower adjacent to the first side edge and to the first end edge thereby forming a first pocket, a magnet positioned within the first pocket; and a second patch with stitching coupling the second patch to the under surface of the tower adjacent to the second side edge and to the first end edge thereby forming a second pocket, a disc with ferromagnetic properties positioned within the second pocket, the second end edge being devoid of pockets and magnets.

2. The system as set forth in claim 1 wherein the magnet is fabricated of a rare earth material.

3. The system as set forth in claim 1 wherein the long parallel first and second side edges are separated by a minimum width of 15 inches plus or minus 10 percent and a maximum width of 16 inches plus or minus 10 percent, and wherein the short parallel first and second end edges are separated by a minimum width of 18 inches plus or minus 10 percent and a maximum width of 26 inches plus or minus 10 percent.

4. The system as set forth in claim 1 wherein each patch is in a square configuration with each side of the patch being between 1.5 and 1.75 inches.

5. A magnetic anchoring towel system (10) for providing a perspiration wiping surface and for reliable positioning and repositioning such surface, the system comprising, in combination:

a towel (14) having long parallel first and second side edges (16), (18) separated by a minimum width of 15 inches plus or minus 10 percent and a maximum width of 16 inches plus or minus 10 percent, the towel having short parallel first and second end edges (20), (22) separated by a minimum width of 18 inches plus or minus 10 percent and a maximum width of 26 inches plus or minus 10 percent, the towel being fabricated of a cotton fiber content and having a top surface (24) in a velour texture providing a softer feel and an under surface (26) with a looped face for more absorbency, a dobby hem formed along all side and end edges to facilitate unraveling;

a first patch (30) in a square configuration wherein each side of the patch is between 1.50 and 1.75 inches, first peripheral stitching (32) coupling the first patch to the under surface of the tower adjacent to the first side edge and the first end edge thereby forming a first pocket, a rare earth magnet (34) having a cylindrical configuration positioned within the first pocket, the magnet having a diameter of between 0.75 and 1.25 inches and a height of 0.125 inches plus or minus 10 percent, the magnet adapted to be removably attached to a magnetically responsive object including a handle of a weight machine; and a second patch (38) in a square configuration with each side of the patch being between 1.5 and 1.75 inches, second peripheral stitching (40) coupling the second patch to the under surface of the tower adjacent to the second side edge and the first end edge thereby forming a second pocket, a disc (42) of an iron alloy with ferromagnetic properties, the disc having a cylindrical configuration positioned within the second pocket, the disc adapted to be removably attached to the magnet for forming the first edge of the towel into a loop positionable around an object including a handle of a weight machine and a portion of golf equipment.

* * * * *